US008448722B2

(12) United States Patent
Konschuh et al.

(10) Patent No.: US 8,448,722 B2
(45) Date of Patent: May 28, 2013

(54) DRILLING STABILIZER

(75) Inventors: Christopher Konschuh, Calgary (CA); Daniel Robson, Okotoks (CA); Laurier Comeau, Leduc (CA); Paul Sibbald, Calgary (CA)

(73) Assignee: Arrival Oil Tools, Inc., Calgary (CA)

( * ) Notice: Subject to any disclaimer, the term of this patent is extended or adjusted under 35 U.S.C. 154(b) by 286 days.

(21) Appl. No.: 12/773,167

(22) Filed: May 4, 2010

(65) Prior Publication Data

US 2011/0272196 A1 Nov. 10, 2011

(51) Int. Cl.
*E21B 17/10* (2006.01)

(52) U.S. Cl.
USPC ..... 175/73; 175/325.1; 175/325.2

(58) Field of Classification Search
USPC ..... 175/73, 76, 99, 232, 325.1, 325.4, 175/323, 432, 61, 325.2
See application file for complete search history.

(56) References Cited

U.S. PATENT DOCUMENTS

| | | | | |
|---|---|---|---|---|
| 2,794,617 | A * | 6/1957 | Yancey | 175/323 |
| 4,407,377 | A | 10/1983 | Russell | |
| 4,467,879 | A * | 8/1984 | Burge | 175/325.4 |
| 4,491,187 | A | 1/1985 | Russell | |
| 4,796,670 | A * | 1/1989 | Russell et al. | 138/110 |
| 4,848,490 | A * | 7/1989 | Anderson | 175/323 |
| 4,854,399 | A * | 8/1989 | Zijsling | 175/61 |
| 5,181,576 | A * | 1/1993 | Askew et al. | 175/61 |
| 6,328,119 | B1 | 12/2001 | Gillis | |
| 2007/0102151 | A1 | 5/2007 | Abdo | |

FOREIGN PATENT DOCUMENTS

| | | |
|---|---|---|
| GB | 2133059 | 7/1984 |
| GB | 2164372 | 11/1984 |

OTHER PUBLICATIONS

Sperry-Sun Adjustable Gauge Stabilizer (AGS) http://www.halliburton.com/ps/default.aspx?pageid=247&navid=20 &prodid=MSE::1055447522413946.
Andergauge; Hydraulic and Mechanical Andergauge http://www.andergauge.com/.
National Oilwell Varco; Hydrastab Variable Gauge Stabilizer http://www.nov.com/Downhole/Drilling_Tools/Variable_Gauge_Stabalizers.aspx.
Great Britain Search Report and Search Opinion for GB Application No. 1105679.3, dated May 4, 2011, 5 pages.

* cited by examiner

*Primary Examiner* — David Andrews
*Assistant Examiner* — Ronald Runyan
(74) *Attorney, Agent, or Firm* — Wong, Cabello, Lutsch, Rutherford & Brucculeri, LLP

(57) ABSTRACT

A downhole, hydraulically actuated drilling stabilizer that provides versatility in a bottom-hole assembly. The drilling stabilizer can be used in a directional drilling application to help control the inclination in an extended reach or horizontal well. The drilling stabilizer has stabilizer blade members with an angular design portion that provides versatility in a bottom-hole assembly. The stabilizer could also be used in a conventional rotary bottom-hole assembly, or positioned below a steerable motor.

18 Claims, 4 Drawing Sheets

DRILLING STABILIZER

FIELD OF THE INVENTION

The present invention relates to directional drilling and more specifically to a drilling stabilizer suitable for use in downhole drilling operations.

BACKGROUND

Directional drilling involves controlling the direction of a wellbore as it is being drilled. It is often necessary to adjust the direction of the wellbore frequently while directional drilling, either to accommodate a planned change in direction or to compensate for unintended and unwanted deflection of the wellbore.

Directional drilling typically utilizes a combination of three basic techniques, each of which presents its own special features. First, the entire drill string may be rotated from the surface, which in turn rotates a drilling bit connected to the end of the drill string. This technique, sometimes called "rotary drilling", is commonly used in non-directional drilling and in directional drilling where no change in direction during the drilling process is required or intended. Second, the drill bit may be rotated by a downhole motor that is powered, for example, by the circulation of fluid supplied from the surface. This technique, sometimes called "sliding drilling," is typically used in directional drilling to effect a change in direction of a wellbore, such as in the building of an angle of deflection, and almost always involves the use of specialized equipment in addition to the downhole drilling motor. Third, rotation of the drill string may be superimposed upon rotation of the drilling bit by the downhole motor.

In the drill string, the bottom-hole assembly is the lower portion of the drill string consisting of the bit, the bit sub, a drilling motor, drill collars, directional drilling equipment and various measurement sensors. Typically, drilling stabilizers are incorporated in the drill string in directional drilling. The primary purpose of using stabilizers in the bottom-hole assembly is to stabilize the bottom-hole assembly and the drilling bit that is attached to the distal end of the bottom-hole assembly, so that it rotates properly on its axis. When a bottom-hole assembly is properly stabilized, the weight applied to the drilling bit can be optimized.

A secondary purpose of using stabilizers in the bottom-hole assembly is to assist in steering the drill string so that the direction of the wellbore can be controlled. For example, properly positioned stabilizers can assist either in increasing or decreasing the deflection angle of the wellbore either by supporting the drill string near the drilling bit or by not supporting the drill string near the drilling bit.

Conventional stabilizers can be divided into two broad categories. The first category includes rotating blade stabilizers which are incorporated into the drill string and either rotate or slide with the drill string. The second category includes non-rotating sleeve stabilizers which typically comprise a ribbed sleeve rotatable mounted on a mandrel so that, during drilling operations, the sleeve does not rotate while the mandrel rotates or slides with the drill string. Some stabilizers have blades that are of a fixed gauge and other stabilizers, typically referred to as adjustable gauge stabilizers, have the ability to adjust the gauge during the drilling process.

Although a stabilizer having straight blades is suitable for slide drilling, straight blades tend to cause shock and vibration in the bottom-hole assembly when rotary drilling. Wrapped blades can limit vibration in the bottom-hole assembly when the drill string is rotated. However, during slide drilling, wrapped blades tend to "corkscrew" themselves into a tight wellbore and get stuck. This invention seeks to provide an adjustable gauge stabilizer that is beneficial for slide drilling, while providing more circumferential contact with the borehole wall. This contact will prevent detrimental downhole shocks and vibrations when the drill string is rotated.

SUMMARY OF THE INVENTION

A downhole, hydraulically actuated drilling stabilizer is described that provides versatility in a bottom-hole assembly. The drilling stabilizer can be used in a directional drilling application to help control the inclination in an extended reach or horizontal well. The stabilizer has an unconventional, angular design portion that provides versatility in a bottom hole assembly. The stabilizer can also be used in a conventional rotary bottom hole assembly, or positioned below a steerable motor.

The stabilizer afforded by this invention has a blade design that incorporates an angular profile between the essentially straight end portions of the blade for better circumferential coverage. The leading and trailing portions of the blade are straight, and beneficial for slide drilling. The apex area of the angular profile portion of the blade provides greater circumferential contact with the borehole wall, and is beneficial for rotary drilling.

BRIEF DESCRIPTION OF THE DRAWINGS

FIG. 1 illustrates the drilling stabilizer and stabilizer blade area.

FIG. 2 illustrates an isometric view of the stabilizer blade area of the drilling stabilizer.

FIG. 3 illustrates a cross-section of the stabilizer blade area of the drilling stabilizer.

FIG. 4 illustrates the drilling stabilizer in various operations positions.

DETAILED DESCRIPTION OF THE PREFERRED EMBODIMENTS

Describing now the preferred embodiments of the invention, this is shown in FIGS. 1 through 4. In describing various locations on the stabilizer, the term "downhole" 2 identified in FIG. 1 refers to the direction along the axis of the wellbore that looks toward the furthest extent of the wellbore. Downhole is also the direction toward the drill bit location. Likewise, the term "uphole" 1 refers to the direction along the axis of the wellbore that leads back to the surface, or away from the drill bit. In a situation where the drilling is more or less along a vertical path, downhole is truly in the down direction, and uphole is truly in the up direction. However, in horizontal drilling, the terms up and down are ambiguous, so the terms downhole 2 and uphole 1 are necessary to designate relative positions along the drill string. Similarly, in a wellbore approximating a horizontal direction, there is the "high" side of the wellbore and the "low" side of the wellbore, which refer, respectively, to those points on the circumference of the wellbore that are closest, and farthest, from the surface of the land or water.

Figure 1:
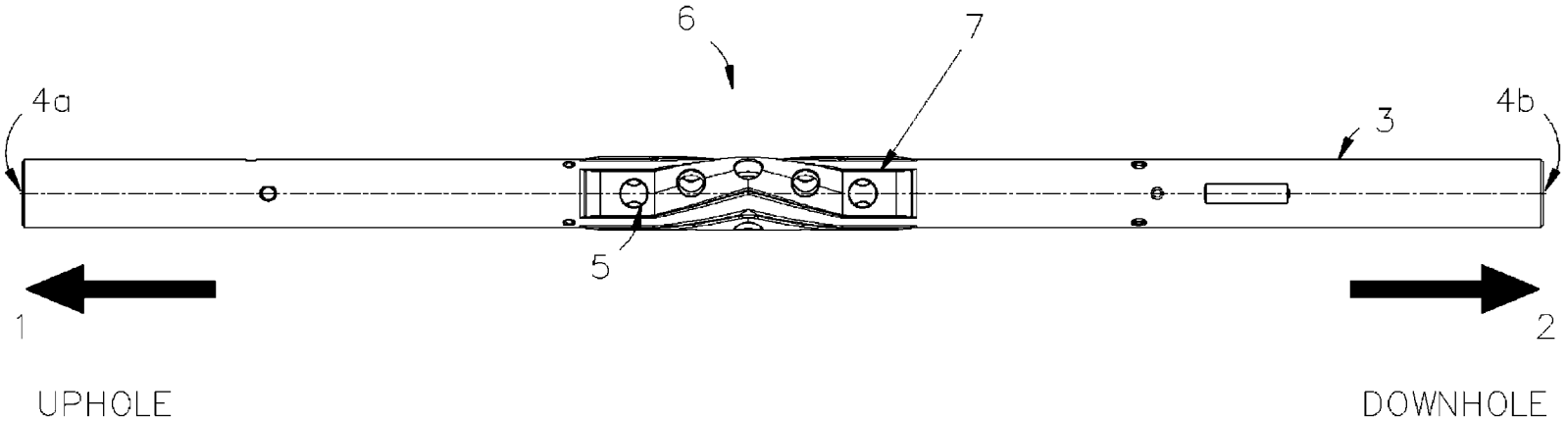
FIGS. 1 thru 4 illustrate the preferred embodiment of the drilling stabilizer.

FIG. 1 illustrates the drilling stabilizer in accordance with the present invention. In the preferred embodiment of the invention, the drilling stabilizer comprises a tubular body member 3 and a stabilizer blade area 6 having a plurality of blade members 7. The stabilizer blade area 6 is centered in the illustrated embodiment along the tubular body member 3 of the drill stabilizer. Mechanical couplings, such as threaded end sections, comprise uphole coupling 4*a* and downhole coupling 4*b* at the uphole and downhole ends, respectively, of the body member 3. The couplings 4*a* and 4*b* are used to attach the tubular body member 3 of the drilling stabilizer at various locations within a drill string or bottom-hole assembly. The drilling stabilizer can be used in a conventional rotary bottom-hole assembly, or positioned either above or below a steerable motor, as is know in the art of directional drilling. The piston elements 5 are located and within each blade member 7 in the blade area 6.

Figure 2:
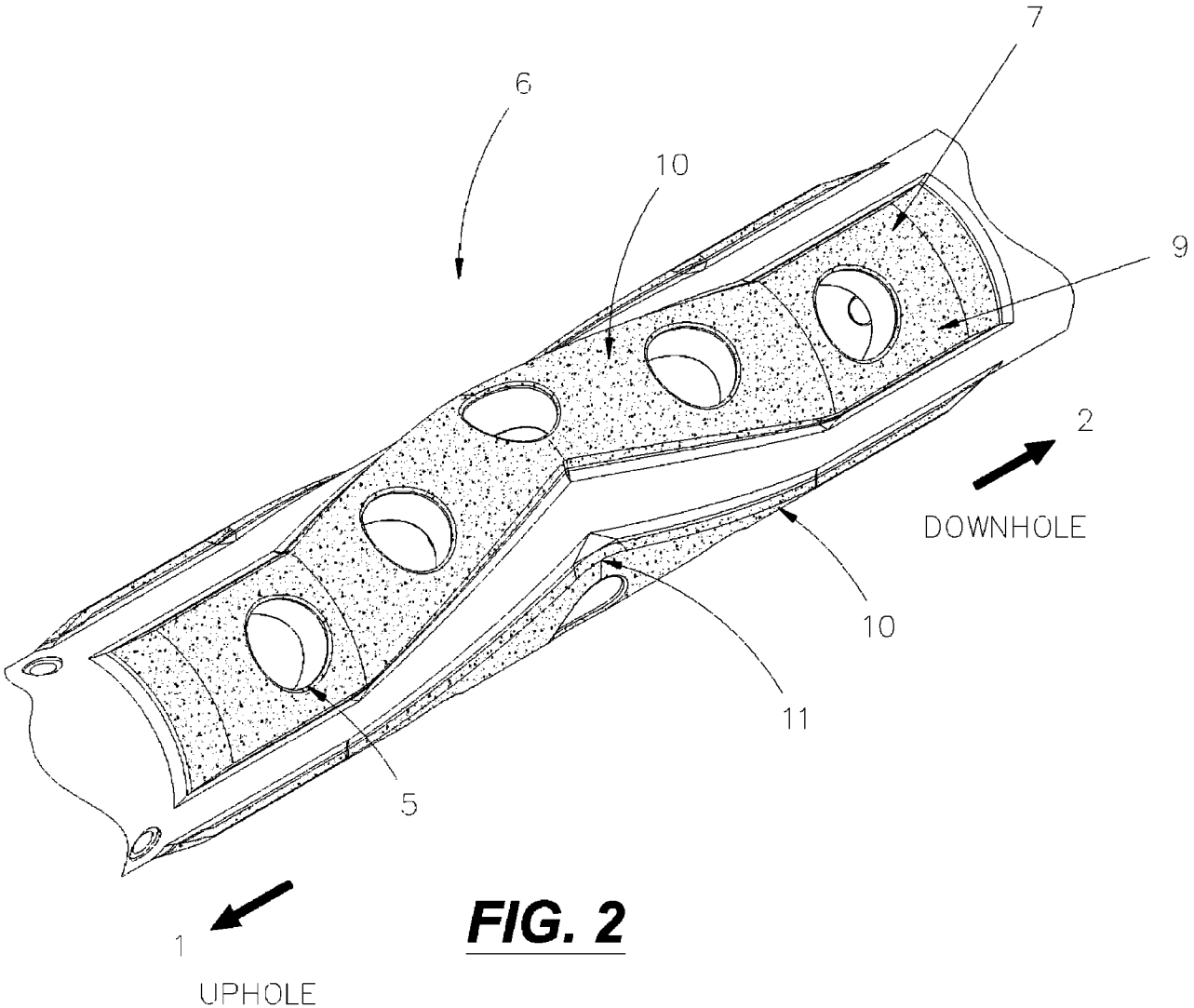

FIG. 2 illustrates in more detail the stabilizer blade area 6 of the drilling stabilizer. Each blade member 7 comprises essentially a straight portion 8 located at the uphole end-portion of the blade member 7, also referred to as the trailing portion, and a straight portion 9 located at the downhole end-portion of the blade member 7, also referred to as the leading portion. The uphole and downhole straight portions 8 and 9 each have a longitudinal axis which is in substantial alignment with the longitudinal axis of said tubular body member 3. Located between the uphole straight portion 8 and the downhole straight portion 9 is an angular profile 10. The angular profile 10 in the preferred embodiment comprises a chevron or V-shaped portion having an apex 11. In the preferred embodiment the apex 11 of each angular profile 10 of each blade member 7 are in circumferential alignment.

Figure 3:
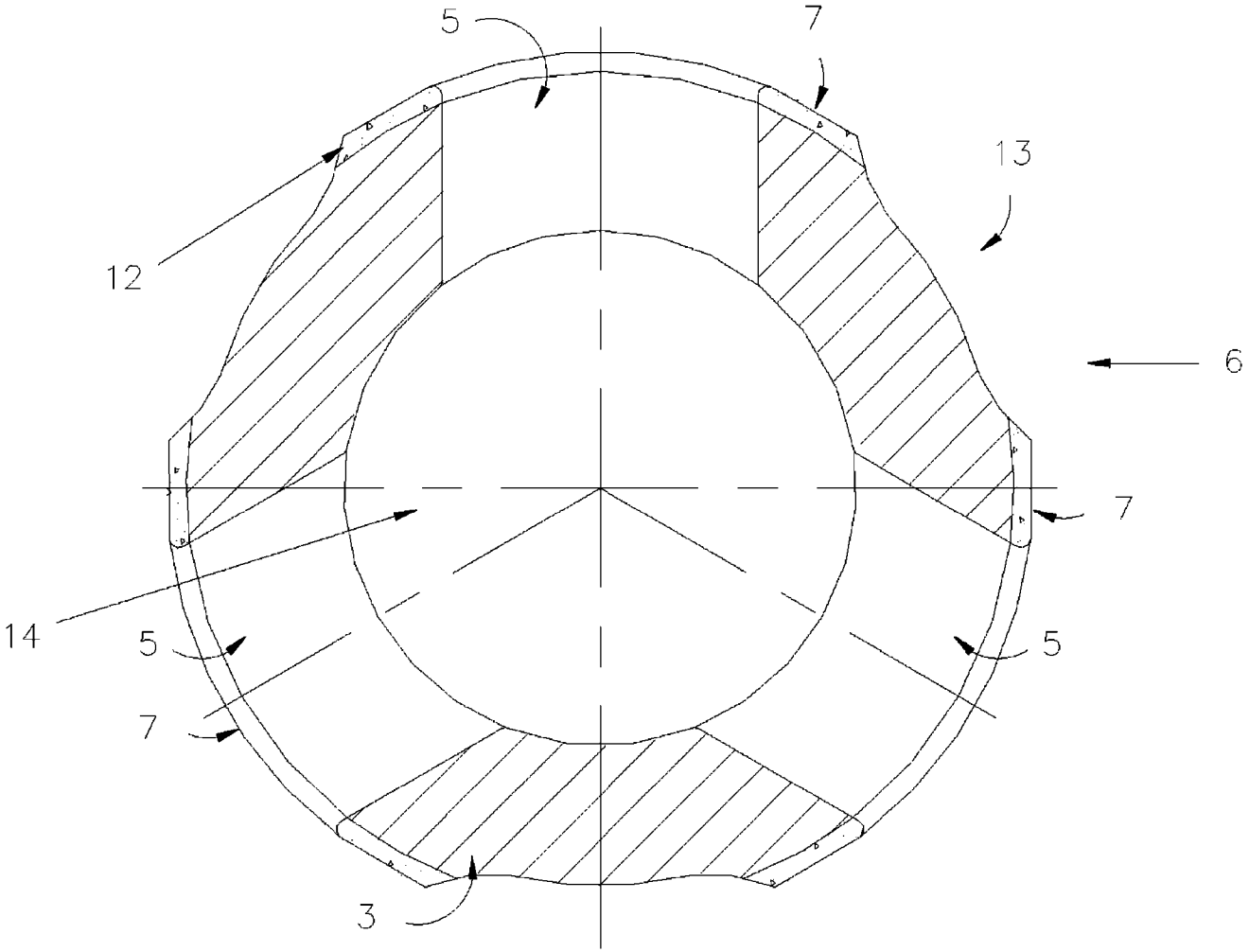

Referring now to FIG. 3, there is illustrated a cross-section view the stabilizer blade area 6, which in the illustrated embodiment comprises three stabilizer blades 7 forming groove portions 13 between the stabilizer blade members 7 for fluid flow on the outside of the blade area 6. Passageway 14 allows for the flow of drilling fluids through the tubular member 3. The stabilizer blade members 7 extend radially outward from the axis of the tubular body member 3. Each blade member 7 is comprised of a hardfacing surface 12, which is capable of withstanding contact with the wall of the wellbore during drilling operations. The hardfacing surface 12 represents the outermost diameter of each blade member 7. As illustrated, the hardfacing surface 12 presents an arc shape for conformance with the wall of the borehole. The piston elements 5 are located within and along the length of each blade member 7.

Figure 4:
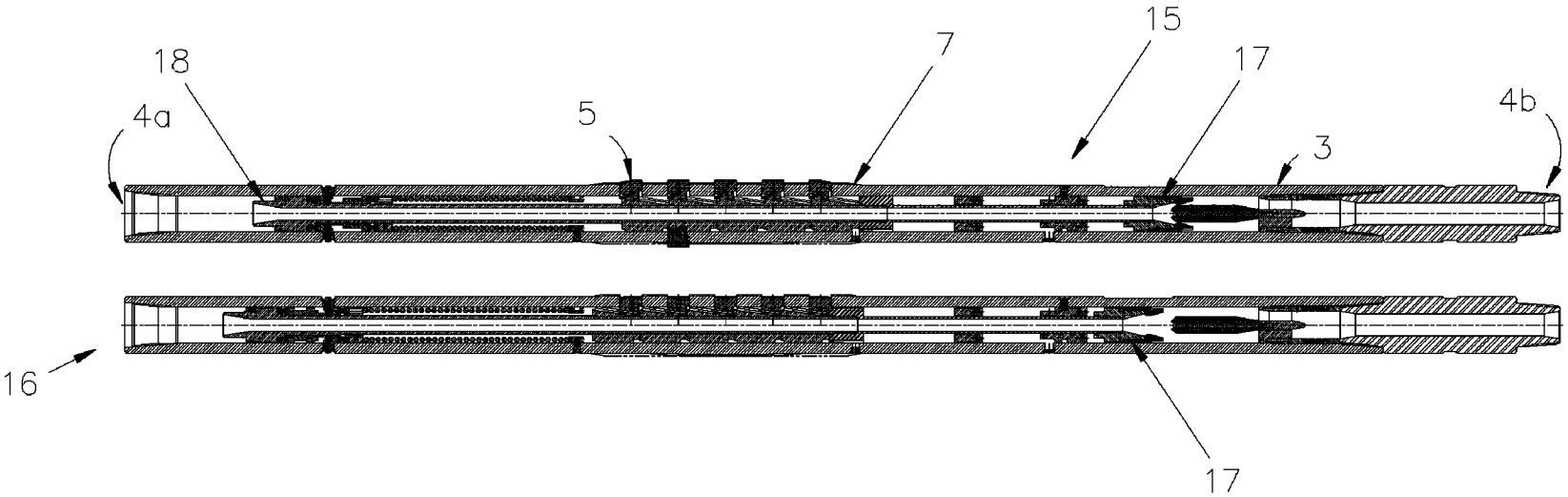

FIG. 4 illustrates the drilling stabilizer in various functional positions. The pumps on—extended operational position is illustrated at 15. In the pumps on—extended operational position drilling fluid from the surface location creates a differential pressure across the internal components of the drilling stabilizer. The differential pressure acts to shift a pressure responsive member 18, which in the illustrated embodiment comprises an internal mandrel, in the downhole direction, which in turn shifts the piston assemblies 5 located along each stabilizer blade 7 so that a portion of each piston of each piston assembly 5 extends beyond the hardfacing surface 12 of each stabilizer blade 7. When the internal mandrel 18 is shifted in the downhole direction, the flow control assembly 17 is moved to the closed position. The flow control assembly 17 creates a pressure restriction that can be monitored from the surface of the wellbore, and indicate whether the pumps are in the extended position.

Referring still to FIG. 4, the pumps off—retracted operational position is illustrated at 16. In the pumps off—retracted operational position there is no differential pressure acting across the internal components of the drilling stabilixer. The internal mandrel 18 remains in the uphole position and the piston assemblies 5 are retracted below the hardfacing surface 12 of each stabilizer blade 7.

As illustrated in FIG. 4, the surface pumps (not shown) can be manipulated at the surface location. Thus, the drilling stabilizer does not have to be tripped out of the hole to cycle the gauge diameter of the blades and pistons between its various operational positions. When the pistons in the stabilizer blades 7 are extended, there is a 150 psi to 250 psi increase in the standpipe pressure compared to when the pistons are flushed to the blades 7 drilling of the stabilizer. This pressure increase can easily be monitored on the rig floor standpipe pressure gauge to determine the position setting of the drilling stabilizer when it is downhole.

The drilling stabilizer described herein includes a stabilizer blade member pattern which is optimized for use in both slide drilling and rotary drilling applications. The straight portions 8 and 9 of the blade members 7 are beneficial when slide drilling. The angular portion 10, containing the apex 11, is beneficial in rotary drilling due to the circumferential contact with the borehole wall that the blade members 7 provide.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A drilling stabilizer, comprising:

a tubular body member; and a plurality of blade members extending radially outward from said tubular body member and arranged circumferentially on said tubular body member, each blade member having a leading and a trailing end portion with an angular shaped profile portion between said leading and said trailing end portions, wherein the angular portion of the blade member forms an angle in a circumferential direction about an outer diameter of the drilling stabilizer, and wherein the leading and trailing portions have a longitudinal axis substantially aligned with a longitudinal axis of the tubular body, and wherein an apex of the angular portion is disposed circumferentially distal to the longitudinal axis of the leading portion and the trailing portion.

2. The drilling stabilizer according to claim 1, wherein said leading and said trailing end portions comprise essentially straight portions of said blade member.

3. The drilling stabilizer according to claim 1, wherein said angular shaped profile portion comprises a chevron or V-shaped profile.

4. The drilling stabilizer according to claim 1, wherein said blade members are arranged having said angular shaped profile portion centered essentially between straight areas.

5. The drilling stabilizer according to claim 1, wherein said blade members are located substantially at the center of the tubular body member.

6. The drilling stabilizer according to claim 1, wherein said blade members further comprises an outer layer of hardfacing material.

7. The drilling stabilizer of claim 1, wherein apexes of the angular portions are in circumferential alignment with each other.

8. An adjustable gauge stabilizer for use in a drill string, comprising:

an elongated tubular member;

a stabilizer blade area having a plurality of outwardly extending stabilizer blades, the blades comprising:

a straight profile, having a longitudinal axis substantially aligned with a longitudinal axis of the tubular member; and an angular profile, disposed with the straight profile, the angular profile forming an angle in a circumferential direction about an outer diameter of the stabilizer blade area;

a plurality of piston elements along said stabilizer blades; and a pressure responsive member for extending a portion of said piston elements outwardly from said blades in response to fluid pressure.

9. The adjustable gauge stabilizer of claim 8 wherein said straight profiles further comprises essentially straight leading and a trailing end portions.

10. The adjustable gauge stabilizer of claim 9 wherein said angular profiles are located between said leading and said trailing end portions.

11. The adjustable gauge stabilizer of claim 10 wherein said angular profile is centered essentially between leading and said trailing end portions.

12. The adjustable gauge stabilizer of claim 11 wherein said angular profiles comprises a chevron or V-shaped profile.

13. The adjustable gauge stabilizer of claim 12, wherein said stabilizer blades further comprises an outer layer of hardfacing material.

14. The adjustable gauge stabilizer of claim 13, further comprising a flow control assembly for creating a pressure signal when said piston elements are in the extended position.

15. The adjustable gauge stabilizer of claim 14, further comprising connections located at each end of said tubular member for connecting said stabilizer into said drill string.

16. The adjustable gauge stabilizer of claim 8, wherein apexes of the angular portions are in circumferential alignment with each other.

17. The adjustable gauge stabilizer of claim 8, wherein a radially outward surface of the angular portion presents an arc shape for conformance with a wall of a borehole.

18. The adjustable gauge stabilizer of claim 8, wherein the straight profile has a longitudinal axis substantially aligned with a longitudinal axis of the tubular body, and wherein an apex of the angular portion is disposed circumferentially distal to the longitudinal axis of the straight profile.

* * * * *